US005102423A

United States Patent [19]

Iwami

[11] Patent Number: 5,102,423

[45] Date of Patent: Apr. 7, 1992

[54] CLOTH TREATMENT METHOD USING DIRECT CURRENT

[75] Inventor: Hideo Iwami, Kyoto, Japan

[73] Assignee: Naigai Special Dyeing Co., Ltd., Kyoto, Japan

[21] Appl. No.: 335,925

[22] Filed: Apr. 11, 1989

[30] Foreign Application Priority Data

Oct. 4, 1988 [JP] Japan ..... 63-250625

[51] Int. Cl.[5] ..... D06M 10/00

[52] U.S. Cl. ..... 8/115.52; 204/133; 204/134; 8/115.51; 205/160

[58] Field of Search ..... 8/115.52; 204/21, 133, 204/134

[56] References Cited

U.S. PATENT DOCUMENTS 1,972,608 9/1934 Uhlmann et al. ..... 8/115.2

1,992,778 2/1935 Seidel et al. ..... 8/115.2

*Primary Examiner*—Prince Willis, Jr.

*Assistant Examiner*—John F. McNally

*Attorney, Agent, or Firm*—Lowe, Price, Leblanc & Becker

[57] ABSTRACT

A cloth treatment method includes the steps of dipping a cloth in a solution of a treating substance to wet the cloth therewith, squeezing the cloth to uniformly impregnate it with the substance, disposing the cloth impregnated with the treating solution between two electrode rolls parallel to each other, and applying a voltage to the two electrode rolls to pass an electric current between therebetween through the treating solution with which the cloth is impregnated, whereby heat generated due to electric resistance of the treating solution promotes fixation of the treatment substance to the fabric.

17 Claims, 2 Drawing Sheets

CLOTH TREATMENT METHOD USING DIRECT CURRENT

BACKGROUND OF THE INVENTION

1. Field of the Invention

The present invention relate to a method for treating a cloth, and more particularly to at reatment method in which, for example in a dyeing process, a cloth to be treated is dipped in a solution, e.g., dye or resin solution, and is wet and impregnated with a substance such as dye, resin, chemical or the like contained in the solution, and then heating the substance electrically so that it is physically or chemically fixed to the cloth.

2. Background of the Prior Art

Dyeing processes heretofore known are generally classified into different methods. The first method is continuous dyeing in which, after a cloth to be treat is impregnated with a dye, the whole cloth is uniformly squeezed so that a certain amount of the dye may be fixed to the cloth, then the dye is further fixed to the cloth by heating the cloth by vapor heating, hot air heating, etc. The second method is barch dyeing in which a batch the cloths each cut into a certain length are dyed.

Further, from the viewpoint of apparatus or system to be used, the conventional dyeing processes are also classified into following three method. The first method is jigger dyeing in which a cloth spread out is wound round a cylinder to be dyed by repeating normal rotation and reverse rotation of the cylinder. The second method is wince dyeing in which each cloth of a plurality of cloths is formed into a shape of string by being squeezed in a longitudinal direction, the string-like cloth is placed on a rotary wheel and ends of each cloth are sewn to those of other strings eventually forming a looped, and the loop cloths are subjected to dyeing. The third method is circular dyeing in which a cloth of about 500 m (50 m × 10 rolls) in length is formed into a shape of a string, which is then circulated in a cylinder together with a dye solution. The fourth method, i.e., jet dyeing, has been increasingly employed in recent years.

The foregoing known dyeing methods, rsepectively, have their own advantages and disadvantages. That is, the continuous dyeing is certainly suited for mass treatment, but there is a difficulty in adjustment of deep color dyeing, and thus the method is not suited for dying small amount of cloth or short cloth. To the contrary, the batch dyeing is certainly suited for dyeing a cloth of small dimensions or length, but neds a relatively long treating time of two hours or so, and thus the method is not suited for treatment of continuous dyeing.

In jigger dyeing, there is a problem that the two end portions of cloth to be treated are deeply colored with dye, and that it takes a long time before completing the treatment because rotation of the cylinder should be repeated in even numbers.

In wince dyeing, there is a problem of requiring a large amount of dye and that it takes a long time before completing the treatments. Moreover, it is required a troublesome work such as taking out the treated cloths one by one in this method.

In circular dyeing, there is a problem requiring troublesome work such as spreading out the treated cloth after completing the dyeing process.

As a further problem common to all of the foregoing conventional treatment methods, a considerable amount of water is essential the treatment mechanism is large-scaled.

SUMMARY OF THE INVENTION

The present invention was made to solve the above problems and has an object of providing a cloth treatment method by which continuous treatment of a cloth in a spread state can be carried out with a simple mechanism, by which even a cloth of small dimensions or length can be easily dyed, and by which deep color adjustment can be easily carried out.

In order to achieve the foregoing object, in the cloth treatment method in accordance with the rpesent invention a cloth to be treated is dipped in a treating solution and wet thereby to be impregnated with a treating substance, the treating substance being fixed to the cloth by the steps of dipping the cloth to be treated in the treating solution, squeezing the cloth, disposing th cloth wet and impregnated with the treating solution between two electrode rolls (or rolelrs) opposed in parallel to each other, and applying a voltge to the two electrode rolls to pass a current between the two electrode rolls through teh treating solution with which the cloth is impregnated, whereby heat being generated due to electric resitance of the treating solution affixes the treatment substance to the fabric.

In the cloth treatment method described above, when applying a voltage to the two electrode rolls, a part of the electric energy passing throug hthe treating solution with which the cloth to be treated is impregnated is converted to a heat energy by generation of heat due to electric resistance of the treating solution, whereby the temperature of both treating solution and cloth is increased, the treating substance contained in the treating solution being thus physically and chemically fixed to the cloth. The treated cloth can be continouously treated and conveyed outside by the rotation of each electrode roll. Because the cloth in a spread state is wound over and between the two electrode rolls, there is no troublesome work such as spreading the cloth after completing the treatment, which results in sparing of treating time. Because electric energy is used as a heating energy and electric current is directly applied to the treating solution, a very simplified mechanism is sufficient for conveniently increasing temperature of the cloth as compared with the conventional system wherein vapor or hot air is used as a heating source. Becase the electric current passes almost evenly through the cloth, there is no problem of unwanted deep coloring, and the temperature requird for the treatment can be easily obtained by adjusting the voltage applied. Pieces of cloth of different lengths and dimensions cna also be easily treated by changing the number of electrode rolls used, i.e., by adding more rolls if needed. Furthermore, the cloth treatment method is also adaptable for mass treatment.

Other objects and advantages of the invention will become apparent in the course of the following description with reference to the accompanying drawings.

DESCRIPTION OF THE PREFERRED EMBODIMENT

A preferred embodiment of the present invention is now described hereinafter with reference to the accompanying drawings.

Figure 2:
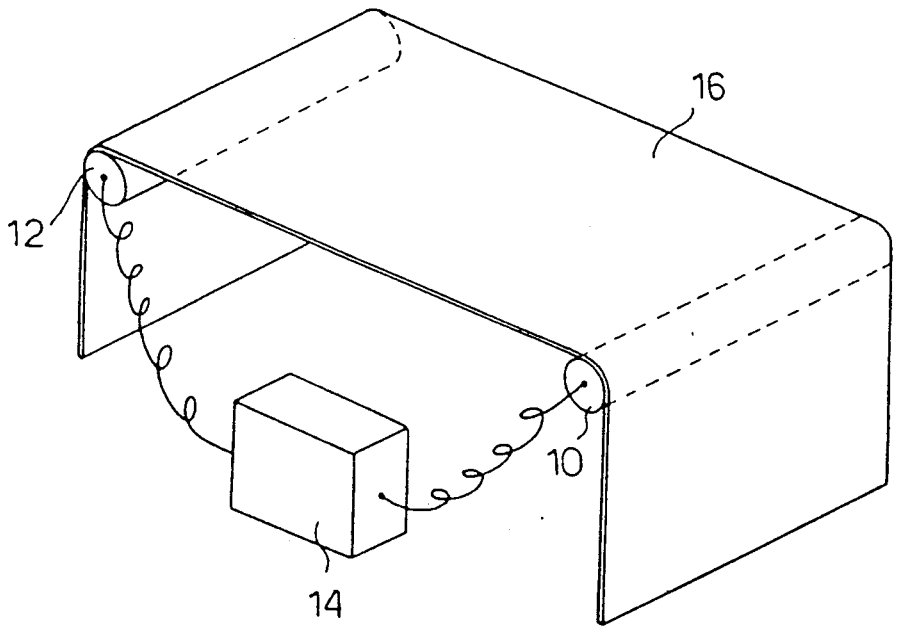
FIG. 2 is a perspective view to explain the basic arrangement of elements for practicing the preferred cloth treatment method.

Describing first the basic technological arrangement of the invention referring to FIG. 2, the anode side electrode roll 10 and the cathode side electrode roll 12, both comprising an electrical conductor, are opposedly disposed with a certian distance therebetween. An anode and cathode of the DC power supply 14 are respectively connected t othe electrode rolls 10, 12. The cloth 16 to be treated is dipped in the treating solution, and is then squeezed in such a manner between rollers 24 and 26 as to be uniformly impregnated with the treating solution. The wet cloth 16 is then disposed over and between each of at least two electrode rolls 10*a*, 12*a*. In applying a DC voltage from the DC power suppy 14 to the at least two electrode rolls10*a*, 12*a*, because cloth 16 imprengated with the treating solution is in electrical contact with the two electrode rolls 10, 12, a DC current passes from the anode of the DC power supply 14 to the cathode thereof by way of the anode side electrode roll 10*a* through the treating solution impregnated into the cloth 16 and from the cathode side electrode roll 12. At this time, the temperature of the impregnated cloth 16 is raised by heat generation in the treating solution because of the electric resistance of the solution. Thus the temperature can be easily raised, e.g., to 90° C. to 100° C. necessary for dyeing, just by controlling the applied voltage from the DC power supply 14.

Figure 1:
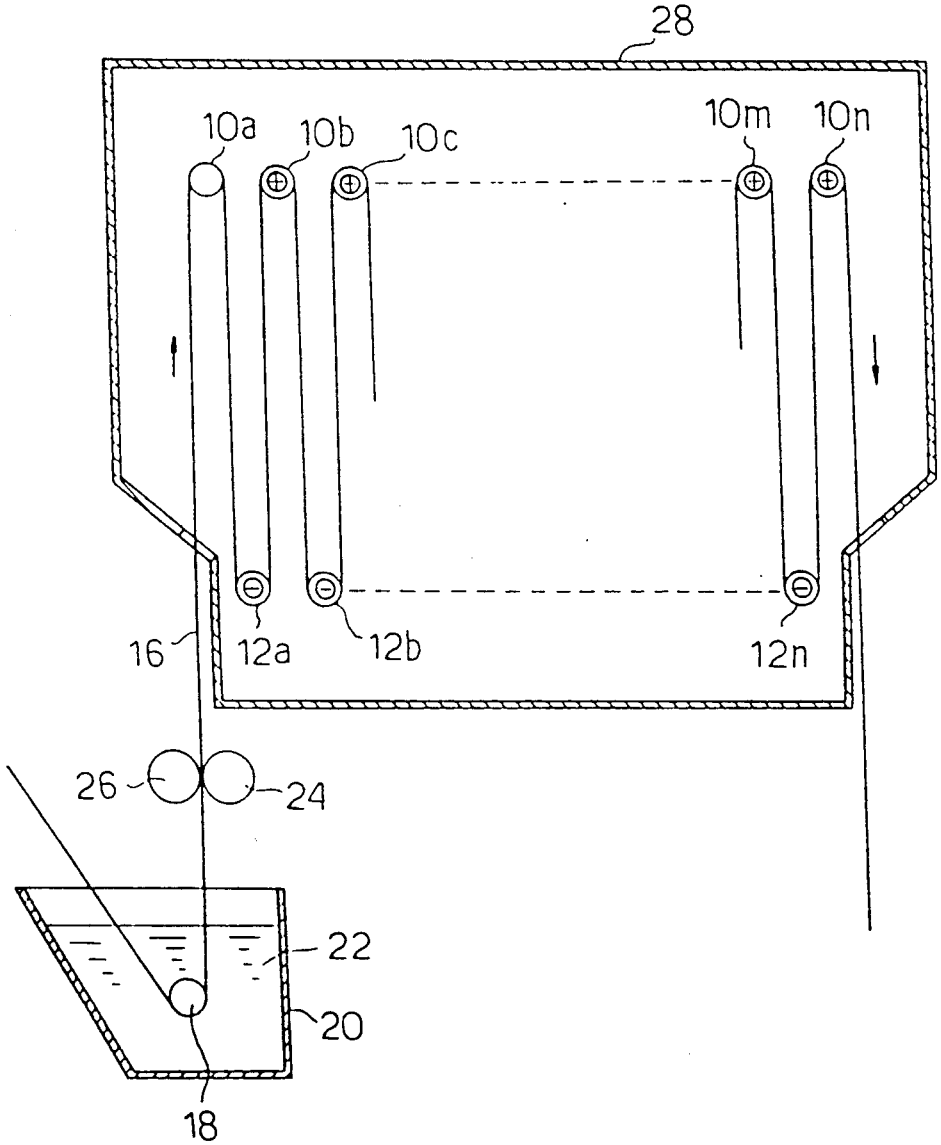
FIG. 1 is a schematic sectional view illustrating an example of a treatment apparatus used for practicing the cloth treatmet method in accordance with the present invention.

FIG. 1 is a schematic view of one exmaple of the apparatus used for embodying the cloth treating method of the invention. In the drawing, the cloth 16 to be treated is dipped in the treating solution 22 in the treating solution tank 20 through the guide roll 18, then squeezed by a pair of squeezing rolls 24, 26 in such a manner as to be impregnated uniformly with the treating chamber 28. A plurality of anode side electrode rolls 10*a* to 10*n* are horizontally disposed in an treating chamber 28 at the upper portion, with a certain distance between one and the other, in such a mnner as to be opposed respectively to each portion located between one and the other of a plurality of cathode side electrode rolls 12*a* to 12*n*. The cloth 16 guided into the treating chamber 28 is alternately wound round the anode side electrode rolls 10*a* to 10*n* and the cathode side electrode rolls 12*a* to 12*n*, and conveyed in the direction of the arrow by rotational drive of a torque motor (not illustrted) to be finally sent outside the treating chamber 28.

The anode side electrode rolls 10*a* to 10*n* and the cathode side electrode rolls 12*a* to 12*n* are respectively connected to the anode and cathode of the DC power supply so that a DC voltage corresponding to treatment speed may be applied to the anode side electrode rolls 10*a* to 10*n* and the cathode side electrode rolls 12*a* to 12*n*, the anode side electrode rolls 10 *a* to 10*n* being rotationally driven to convey the cloth 16.

The treating solution 22 with which the cloth 16 is impregnated experiences electrical resistance heating as described. Referring to FIG. 2, the temperature of the cloth 16 is raised and, accordingly, the treating substance such as dye or resin contained in the treating solution 22 is fixed to the cloth 16.

As electricity is used the heating source of the cloth 16 in this embodiment, no vapor is needed, this being different from the conventional treatment. But is may also be desirable to provdie auxiliary heating with a certain amount of vapor to accelerate the dyeing process.

As the cloth 16 is wound round evh of the electrode rolls 10*a* to 10*n* and 12*a* to 12*n* in its spread state, there is not need for troublesome work such as spreading the cloth 16 after the treatment. Varieite sof cloths 16 can be continouosly treated because the number of electrode rolls 10*a* to 10*n* and 12*a* to 12*n* that are engaged by the cloth may be variably changed according to the condition of the cloth 16.

The inventor has actually carried out several experiments to verify that cloths treated by the method of the invention have their performance suitable for conditions of normal use, and results of these experiments are described hereinafte.r

(1) Dyueing with Direct Dyes

A bleached cotton cloth of 130 g/m$^2$ in weight was in a dyeing solution of 10 g/l Kasyarus Spura Browm GTL (trade name produced by Nippon Kayaku Co., Ltd., then was squeexed once at a squeezing percentage of 85%. The wet cotton cloth was laid over and between two electrode rollers 10, 12 illustrated in FIG. 2, and a load of 100 g was applied to both ends of the cloth. Applying B 130 V for 20 seconds form a DC power supply 14 while keeping the cloth in a loaded state, the temperature of the cloth was raised to 90° C., when a dyeing reaction took place. Thus a cloth of required color was obtained after washing with water and drying.

(2) Dyeing with Cationic Dye

A 100% acylic desized cloth of 180 g/m$^2$ in weight was dipped once in a mixed treating solution of 10 g/l Kayacryl Yellow 3RL-ED (trade name, produced by Nippon Kayaku Co., Ltd.), 1 g/l Kayacryl Red GRL-Ed (same as above), 0.5 g/l Kayacry Blue GRL-ED (same as above) and 3 ml/l Naganol (trade name of an organic acid produced by Sanpo Chemical Industry Co., Ltd.), then was squeezed once at a squeezing percentage of 75%. The wet cloth was laid over and between two electrode rollers 10, 12 as illustrated in FIG. 2, and a load of 100 g was applied to both ends of the cloth. Applying B 120 V for 20 seconds from the DC power supply 14 while keeping the cloth in a loaded state, the temperature of the cloth was raised to 95° C., when a dyeing reaction took place. Thus a cloth of required color was obtained.

(3) Polyester Reducing (Finishing)

A polyester desized cloth of 120 g/m$^2$ in weight was dipped once in a mixed treating solution of 250 g/l caustic soda and 3 ml/l penetrant, then was once squeezed at a squeezing percentage of 85%. The wet cloth was laid over and between the two electrode rollers 10, 12 as illustrated in FIG. 2, and a load of 100 g was applied to both ends of the cloth. Applying 120 V for 25 seconds from the DC power supply 14 while keeping the cloth in loaded state, the temperature of the cloth was raised to 95° C. After turning off electricity, the cloth was subjected to washing with water, neutralization by dipping in 2 ml/l acetic acid for 30 seconds washing with water for 1 minute, dehydration squeezing at the squeezing percentage of 75% with mangle, and drying at 120° C. for 3 minutes in order. Thus a cloth of 20% in loss was obtained.

(4) Resin Treatment

A yellow-colored cotton cloth of 150 g/m$^2$ in weight was dipped once in a mixed treating solution of thermosetting resin of 10% Sumitex resin NS-19 (trade name), produced by Sumitomo Chemical Industries Co., Ltd, 3% Accelerator X-80 (same as above), 0.1% Accelerator X-100B (same as above) and 0.5% Silicon Softner N85 (trade name), produced by Matsumoto Yushi Co., Ltd, then was once squeezed at a squeezing percentage of 80%. The wet cloth was laid over and between two electrode rollers 10, 12 as illustrated in FIG. 2, and a load of 100 g was applied to both ends of the cloth. Applying 120 V for 20 seconds from the DC power supply 14 while keeping the cloth in loaded state, the temperature of the cloth was raised to 90° C. After drying the cloth at 120° C. for 2 minutes, the cloth was subjected to heat treatment by heating at 140° C. for 3 minutes. Thus, a treated cloth of low surface resin and good elastic return was obtained.

Having described specific examples of our cloth treatment method, it is believed obvious that modification and variation of the invention is possible in light of the above teachings.

In this disclosure, there are shown and described only the preferred embodiments of th einvention, but, as aforementioned, it is to be understood that the invention is capable of use in various other combination and environments and is capable of changes or modifications within the scope of the inventive concept as expressed herein.

What is claimed is:

1. A cloth treatment method, comprising the steps of:

dipping a length of a cloth to be treated in a treating solution containing a treatment substance in a predetermined concentration, whereby the cloth is wetted and impregnated with said treating solution;

squeezing the wetted cloth to thereby uniformly impregnate the cloth with the treating solution;

disposing the cloth, impregnated with the treating solution, between two conductive electrode rolls rotatably held parallel to each other at a predetermined separation along a length of the cloth extending therebetween; and applying a selected voltage difference between the two electrode rolls, to thereby pass, a direct electric current between the two electrode rolls through the treating solution with which said length of the cloth between the electrode rolls is impregnated, whereby heat is generated in said treating solution and said cloth due to electric resistance of the treating solution and a controlled temperature increase is obtained therein to promote fixation of the treatment substance to the cloth.

2. The cloth treatment method of claim 1, wherein:

a plurality of first rolls is held at a predetermined voltage difference relative to a plurality of second rolls, the impregnated cloth is passed over and between said first and second rolls alternately, and the cloth is heated between each pair of successive rolls by the passage of said direct current through the treatment solution imprengating the cloth, whereby the cloth is repeatedly heated between successive rolls in its passage over and between them to obtain the affixation of the treatment substance to the cloth.

3. The cloth treatment method of claim 1, wherein:

the cloth comprises bleached cotton, the treatment solution contains a dye, and the applied voltage difference is a constant 130 v.

4. The cloth treatment method of claim 2, wherein:

the cloth comprises bleached cotton, the treatment solution contains a dye, and the applied voltage difference is a constant 130 v.

5. The cloth treatment method of claim 1, wherein:

the cloth comprises 100% desized acrylic cloth, the cloth is squeezed once, and the applied voltage difference is a constant 120 v.

6. The cloth treatment method of claim 2, wherein:

the cloth comprises 100% desized acrylic cloth, the cloth is squeezed once, and the applied voltage difference is a constant 120 v.

7. The cloth treatment method of claim 1, wherein:

the cloth comprises polyester, and the treating solution comprises caustic soda and a penetrant in predetermined proportions.

8. The cloth treatment of claim 2, wherein:

the cloth comprises polyester, and the treating solution omprises caustic soda and a penetrant in predetermined proportions.

9. The cloth treatment method of claim 1, comprising the further step of:

applying a predetermined load to the cloth during its passage over and between said electrode rolls.

10. The cloth treatmetn method of claim 2, comprising the further step of:

applying a predetermined load to the cloth during its passage over and between said electrode rolls.

11. The cloth treatment method of claim 3, wherein the voltage difference is applied to raise a temperature of the cloth to 90° C.

12. The cloth treatment method of claim 4, wherein:

the voltage difference is applied to raise a temperature of the cloth to 90° C.

13. The cloth treatment method of claim 5, wherein:

the voltage difference is applied to raise a temperature of the cloth to 95° C.

14. The cloth treatment method of claim 6, wherein:

the voltage different is applied to raise a temperature of the cloth to 95° C.

15. The cloth treatment method of claim 7, wherein:

the voltage difference is applied to raise a temperature of the cloth to 95° C.

16. The cloth treatment method of claim 8, wherein:

the voltage difference is applied to raise a temperature of the cloth to 95° C.

17. The cloth treatment method of claim 1, comprsing the further step of:

drying the cloth at 120° C. for two minutes; and heat treating the cloth at 140° C. for three minutes.

* * * * *